US009994926B2

(12) United States Patent
Li et al.

(10) Patent No.: US 9,994,926 B2
(45) Date of Patent: Jun. 12, 2018

(54) HIGH-HARDNESS, HIGH-TOUGHNESS, WEAR-RESISTANT STEEL PLATE AND MANUFACTURING METHOD THEREOF

(71) Applicant: Baoshan Iron & Steel Co., Ltd., Shanghai (CN)

(72) Inventors: Hongbin Li, Shanghai (CN); Liandeng Yao, Shanghai (CN); Yuchuan Miao, Shanghai (CN)

(73) Assignee: Baoshan Iron & Steel Co., Ltd., Shanghai (CN)

( * ) Notice: Subject to any disclaimer, the term of this patent is extended or adjusted under 35 U.S.C. 154(b) by 436 days.

(21) Appl. No.: 14/418,423

(22) PCT Filed: Jan. 31, 2013

(86) PCT No.: PCT/CN2013/071188
§ 371 (c)(1),
(2) Date: Jan. 29, 2015

(87) PCT Pub. No.: WO2014/019354
PCT Pub. Date: Feb. 6, 2014

(65) Prior Publication Data

US 2015/0329945 A1 Nov. 19, 2015

(30) Foreign Application Priority Data

Jul. 31, 2012 (CN) ..... 2012 1 0270193

(51) Int. Cl.
*C21D 6/00* (2006.01)
*C21D 8/02* (2006.01)
(Continued)

(52) U.S. Cl.
CPC ..... *C21D 8/0205* (2013.01); *C21D 6/002* (2013.01); *C21D 6/005* (2013.01); *C21D 6/008* (2013.01);
(Continued)

(58) Field of Classification Search
CPC ..... C22C 38/00–38/32; C21D 6/00–9/46
See application file for complete search history.

(56) References Cited

U.S. PATENT DOCUMENTS

2013/0216422 A1* 8/2013 Ueda ..... C21D 8/02 420/83

FOREIGN PATENT DOCUMENTS

CN 101775545 B 7/2010
CN 102134682 A 7/2011
(Continued)

OTHER PUBLICATIONS

The International Search Report from PCT/CN2013/071188, dated May 16, 2013 (English Translation).
(Continued)

*Primary Examiner* — Colleen P Dunn
(74) *Attorney, Agent, or Firm* — Kilpatrick Townsend & Stockton LLP

(57) ABSTRACT

The invention provides a wear-resistant steel plate, which has the following chemical composition (wt. %): C: 0.36-0.45%, Si: 0.10-0.30%, Mn: 0.40-1.00%, P≤0.015%, S≤0.010%, Nb: 0.010-0.040%, Al: 0.010-0.080%, B: 0.0010-0.0020%, Ti: 0.005-0.050%, Ca: 0.0010-0.0080%, V≤0.080%, Cr≤1.00%, RE≤0.10%, N≤0.0080%, O≤0.0060%, H≤0.0004%, wherein the total amount of Nb and Ti is between 0.025% and 0.080%, the total amount of Al and Ti is between 0.030% and 0.12%, and the balance being Fe and unavoidable impurities. The invention also provides a method of manufacturing the wear-resistant steel plate, comprising smelting, casting, rolling, post-rolling direct cooling and other steps. The wear-resistant steel plate obtained from the above composition and process has high
(Continued)

hardness and excellent wear resistance, and is suitable for quick-wear devices in engineering machinery, such as crusher baffle, etc.

15 Claims, 1 Drawing Sheet

(51) Int. Cl.

| | |
|---|---|
| ***C22C 38/00*** | (2006.01) |
| ***C21D 9/46*** | (2006.01) |
| ***C22C 38/14*** | (2006.01) |
| ***C22C 38/32*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/24*** | (2006.01) |
| ***C22C 38/26*** | (2006.01) |
| ***C22C 38/28*** | (2006.01) |

(52) U.S. Cl.
CPC ..... *C21D 8/02* (2013.01); *C21D 8/0226* (2013.01); *C21D 8/0263* (2013.01); *C21D 9/46* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/12* (2013.01); *C22C 38/14* (2013.01); *C22C 38/24* (2013.01); *C22C 38/26* (2013.01); *C22C 38/28* (2013.01); *C22C 38/32* (2013.01); *C21D 2211/008* (2013.01)

(56) References Cited

FOREIGN PATENT DOCUMENTS

| | | | |
|---|---|---|---|
| CN | 102605253 | B | 7/2012 |
| CN | 102747282 | A | 10/2012 |
| JP | 61-076615 | A | 4/1986 |
| JP | H04116137 | A | 4/1992 |
| JP | H0849040 | A | 2/1996 |
| JP | H09118950 | A | 5/1997 |
| JP | H09249935 | A | 9/1997 |
| JP | 2012-031510 | A | 2/2012 |

OTHER PUBLICATIONS

CN201210270193.3, Office Action dated Jun. 5, 2015, 8 pages.
CN201210270193.3, Search Report, dated Jun. 5, 2015, 2 pages.
EP13763171.9, Extended European Search Report, dated Oct. 29, 2015, 7 pages.
NZ 614822, Office Action dated Jun. 9, 2015, 2 pages.
AU2013222054 "Office Action" dated Jun. 7, 2017, pp. 1-2.

* cited by examiner

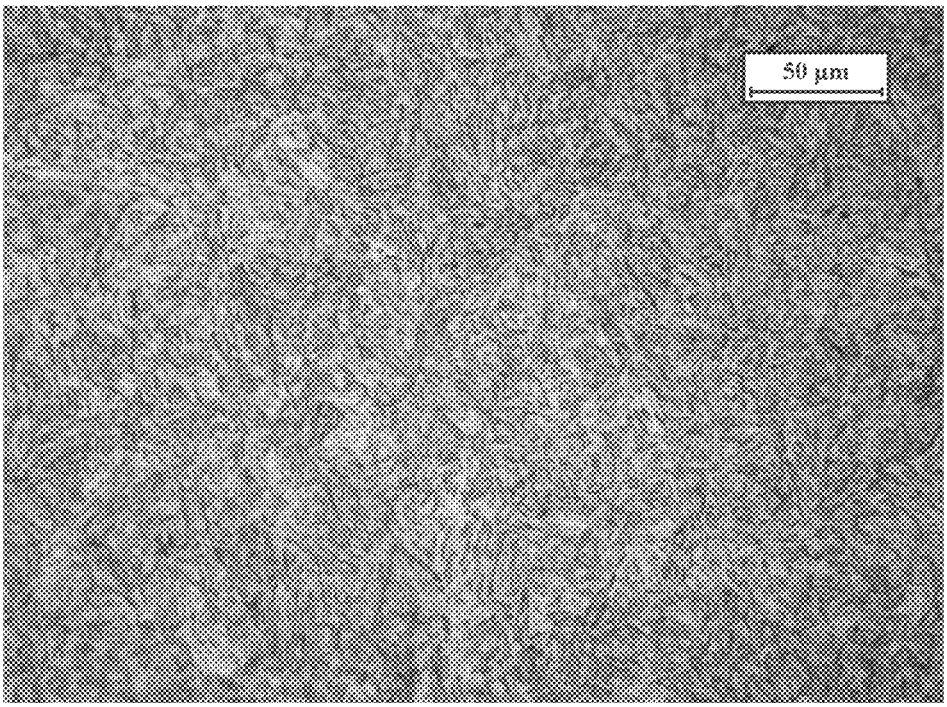
50 μm

HIGH-HARDNESS, HIGH-TOUGHNESS, WEAR-RESISTANT STEEL PLATE AND MANUFACTURING METHOD THEREOF

TECHNICAL FIELD

The invention relates to wear resistant steel, in particular to a high-hardness, high-toughness, wear-resistant steel plate and a method for manufacturing the same.

BACKGROUND ART

The wear-resistant steel plate is widely used for mechanical products for use in engineering, mining, agriculture, cement production, harbor, electric power, metallurgy and the like wherein operating conditions are particularly awful and high strength as well as high wear resistance performances are required. For example, bulldozer, loader, excavator, dump truck and grab bucket, stacker-reclaimer, delivery bend structure, etc. may be mentioned.

In recent decades, the development and application of wear-resistant steel grows quickly. Generally, carbon content is increased and suitable amounts of trace elements such as chromium, molybdenum, nickel, vanadium, tungsten, cobalt, boron, titanium and the like are added to enhance the mechanical performances of wear resistant steel by taking full advantage of various strengthening means such as precipitation strengthening, fine grain strengthening, transformation strengthening and dislocation strengthening, inter alia. Since wear-resistant steel is mostly medium carbon, medium-high carbon or high carbon steel, increase of alloy content leads to increased cost and degraded weldability. These drawbacks refrain further development of wear-resistant steel.

Notwithstanding the wear resistance of a material mainly depends on its hardness, and roughness has important influence on the wear resistance of the material, too. Under complicated working conditions, good wear resistance and long service life of a material can not be guaranteed by increasing the hardness of the material alone. Adjusting the components and thermal treatment process, and controlling the appropriate matching between the hardness and roughness of low-alloy wear-resistant steel, may result in superior comprehensive mechanical performances, so that the requirements of different wearing conditions may be satisfied.

CN 1140205A has disclosed a wear-resistant steel having medium carbon and medium alloy contents, the contents of carbon and alloy elements (Cr, Mo, etc.) of which are higher than those of the present invention. This will inevitably lead to poor weldability and machinability.

CN1865481A has disclosed a wear-resistant bainite steel which has higher contents of alloy elements (Si, Mn, Cr, Mo, etc.) and poorer mechanical properties in comparison with the present invention.

SUMMARY

The object of the invention is to provide a high-hardness, high-toughness, wear-resistant steel plate by realizing the matching between high hardness and high toughness on the basis of adding trace alloy elements, so as to achieve superior machinability which benefits the wide application of the steel plate in engineering.

In order to realize the above object, the high-hardness, high-toughness, wear-resistant steel plate according to the invention comprises the following chemical components in weight percentages: C: 0.36-0.45%, Si: 0.10-0.30%, Mn: 0.40-1.00%, P≤0.015%, S≤0.010%, Nb: 0.010-0.040%, Al: 0.010-0.080%, B: 0.0010-0.0020%, Ti: 0.005-0.050%, Ca: 0.0010-0.0080%, V≤0.080%, Cr≤1.00%, RE≤0.10%, N≤0.0080%, O≤0.0060%, H≤0.0004%, wherein the total amount of Nb and Ti is between 0.025% and 0.080%, the total amount of Al and Ti is between 0.030% and 0.12%, and the balance being Fe and unavoidable impurities.

The microstructure of the wear-resistant steel according to the invention mainly comprises martensite and residual austenite, wherein the volume fraction of the residual austenite is ≤5%.

Another object of the invention is to provide a method of manufacturing the high-hardness, high-toughness, wear-resistant steel plate, wherein the method comprises in sequence the steps of smelting, casting, heating, rolling and cooling, etc. In the heating step, the material is heated to 1000-1250° C. In the rolling step, the initial rolling temperature is 950-1200° C. and the end rolling temperature is 800-950° C. In the post-rolling direct cooling step, water cooling is used and the end cooling temperature is from room temperature to 300° C.

Owing to the scientifically designed contents of carbon and alloy elements according to the invention, the steel plate has excellent mechanical performances (strength, hardness, elongation, impact resistance, inter alia) and wear resistance resulting from the refining and strengthening function of the trace alloy elements as well as the control over the refining and strengthening effect of rolling and cooling processes.

The contents of carbon and trace alloy are controlled strictly according to the invention by reasonably designing the chemical composition (the contents and ratios of C, Si, Mn, Nb and other elements). The production cost of wear-resistant steel is decreased greatly due to the absence of such elements as Mo, Ni and the like.

The steel plate according to the invention has very high hardness and good impact toughness, inter alia, is easy for machining such as cutting, bending, etc., and has very good applicability.

The high-hardness, high-toughness, wear-resistant steel plate according to the invention has a Brinell hardness of 570-630HBW, and a Charpy V-notch longitudinal impact work at −40° C. of 40-60 J. Preferably, the Brinell hardness is 600-630HBW. It has excellent mechanical properties and good applicability.

The invention mainly differs from the prior art steel in the following aspects:

In terms of chemical components, the wear-resistant steel according to the invention incorporates small amounts of such elements as Nb, etc. into its chemical composition in addition to C, Si, Mn and like elements, and thus is characterized by simple composition, low cost, etc.;

In terms of production process, a TMCP process is used to produce the wear-resistant steel according to the invention without off-line quenching, tempering and other thermal treatment procedures, and thus is characterized by a short production flow, high production efficiency, reduced energy consumption, lower production cost, etc.;

In terms of product property, the wear-resistant steel plate according to the invention patent has high hardness and high low-temperature toughness;

In terms of microstructure, the microstructure of the wear-resistant steel according to the invention mainly comprises fine martensite and resudial austenite, wherein the volume fraction of the remained austenite is ≤5%, which facilitates the good matching between the high hardness and toughness of the wear resistant steel plate.

The wear-resistant steel plate according to the invention has relatively remarkable advantages. As the development of social economy and steel industry is concerned, an inevitable tendency is the control of the contents of carbon and alloy elements, and the development of low-cost wear-resistant steel having good mechanical properties via a simple process.

DESCRIPTION OF DRAWINGS

FIG. 1 shows the microstructure of the steel plate according to Example 5, which comprises fine martensite and a small amount of residual austenite and guarantees that the steel plate has good mechanical properties.

DETAILED DESCRIPTION

The functions of the chemical components in the high-hardness, high-toughness, wear-resistant steel plate according to the invention will be described in detail below.

In the invention, unless otherwise specified, contents are represented by weight percentages.

By scientifically designing elemental species and contents thereof, the steel type according to the invention has achieved good matching among super strength, super hardness and high toughness on the basis of the addition of trace alloy elements, and has superior weldability.

Carbon: Carbon is the most basic and important element in wear resistant steel. It can improve the strength and hardness of the steel, and further improve the wear resistance of the steel. However, it is unfavorable for the toughness and weldability of the steel. Hence, the carbon content in the steel shall be reasonably controlled to be 0.36-0.45%, preferably 0.37-0.44%.

Silicon: Silicon forms a solid solution in ferrite and austenite to improve their hardness and strength. However, excessive silicon will decrease the steel toughness sharply. Meanwhile, due to better affinity of silicon with oxygen than that with iron, silicate having low melting point tends to be generated easily during welding, which increases slag and the mobility of molten metals, and thus impacts the quality of the weld. Therefore, silicon content shall be controlled strictly. The content of silicon in the invention is controlled to be 0.10-0.30%, preferably 0.10-0.28%.

Manganese: Manganese significantly increases the hardenability of steel, and lowers the transition temperature of wear-resistant steel and the critical cooling rate of steel. However, higher content of manganese tends to coarsen the grains, increase the temper embrittlement sensitivity of the steel, result in segregation and cracking easily in the cast billet, and degrade the performances of the steel plate. In the invention, the content of manganese is controlled to be 0.40-1.00%, preferably 0.40-0.90%.

Niobium: The function of Nb in grain refining and precipitation strengthening contributes significantly to increased strength and toughness of the material. As an element having a strong propensity to form carbide and nitride, niobium restrains the growth of austenite grains consumingly. Nb increases both the strength and toughness of steel by refining grains. Nb ameliorates and enhances the performances of steel mainly by way of precipitation strengthening and transformation strengthening. Nb has already been considered as one of the most effective strengthening agents in HSLA steel. In the invention, niobium is controlled to be 0.010-0.040%, preferably 0.010-0.035%.

Aluminum: Aluminum and nitrogen in steel can form insoluble fine AlN particles to refine steel grains. Aluminum can refine steel grains, immobilize nitrogen and oxygen in the steel, lessen the notch sensitivity of the steel, reduce or eliminate the aging phenomenon of the steel, and enhance the toughness of the steel. In the invention, the content of Al is controlled to be 0.010-0.080%, preferably 0.020-0.060%.

Boron: Boron improves the hardenability of steel, but excessive content will lead to hot shortness, and impact the hot workability of the steel. In the invention, the content of boron is controlled to be 0.0010-0.0020%, preferably 0.0010-0.0018%.

Titanium: Titanium is one of the elements having a strong tendency to form carbides, and forms fine TiC particles with carbon. TiC particles are very small, and distribute along the crystal boundary, so as to have the effect of refining grains. Harder TiC particles will increase the wear resistance of the steel. In the invention, titanium is controlled to be 0.005-0.050%, preferably 0.010-0.045%.

The addition of niobium and titanium in combination may result in better effect in grain refining, reduce the grain size of the original austenite, favor the martensite lathe after refining and quenching, and increase the strength and wear resistance. The insolubility of TiN and the like at high temperature may prevent grains in the heat affected zone from coarsening, and enhance the toughness of the heat affected zone, so as to improve the weldability of the steel. Hence, the contents of niobium and titanium meet the following relationship: the total amount of Nb and Ti is between 0.025% and 0.080%, preferably between 0.035% and 0.070%.

Titanium can form fine particles and thus refine grains. Aluminum may guarantee the formation of fine titanium particles, so that titanium may play a full role in refining grains. Hence, the content ranges of aluminum and titanium meet the following relationship: the total amount of Al and Ti is between 0.030% and 0.12%, preferably between 0.040% and 0.11%.

Calcium: Calcium has a remarkable effect on the transformation of the inclusions in cast steel. Addition of a suitable amount of calcium in cast steel may transform the long-strip like sulfide inclusions in the cast steel into spherical CaS or (Ca, Mn)S inclusions. Oxide and sulfide inclusions formed from calcium have smaller densities, and thus are easier for floatation and removal. Calcium can also inhibit clustering of sulfur along the crystal boundary notably. These are all favorable for increasing the quality of the cast steel, and thus improving the performances of the steel. When there are a relatively large amount of inclusions, the addition of calcium shows obvious effect, and helps to guarantee the mechanical properties of the steel, in particular toughness. In the invention, calcium is controlled to be 0.0010-0.0080%, preferably 0.0010-0.0060%.

Vanadium: Vanadium is added mainly for refining grains, so that austenite grains will not grow unduly in the stage of heating the billet. As such, in the subsequent several runs of rolling, the steel grains may be further refined to increase the strength and toughness of the steel. In the invention, vanadium is controlled to be ≤0.080%, preferably 0.035-0.080%, still preferably ≤0.060%.

Chromium: Chromium may slow the critical cooling rate and enhance the hardenability of the steel. Several carbides, such as $(Fe,Cr)_3C$, $(Fe,Cr)_7C_3$ and $(Fe,Cr)_{23}C_7$, etc., may be formed from chromium in the steel to improve strength and hardness. During tempering, chromium can prevent or slow down the precipitation and aggregation of the carbides, so that the tempering stability of the steel is increased. In the invention, the chromium content is controlled to be ≤1.0%, preferably 0.35-0.10%, still preferably ≤0.80%.

Rare earth: Rare earth may be added into the steel to lessen segregation of sulfur, phosphorus and other elements, and improve the shape, size and distribution of nonmetallic inclusions. It can also refine grains and increase hardness as well. In addition, rare earth can increase tensile ratio, and help to improve the strength-toughness of low-alloy, high-strength steel. High content of rare earth is undesirable. Otherwise, grievous segregation will occur, and the quality and mechanical properties of the cast billet will be impaired. In the invention, the content of rare earth is controlled to be ≤0.1%, preferably 0.05-0.10%, still preferably ≤0.08%.

Phosphorus and sulfur: Sulfur and phosphorus are both harmful elements in wear resistant steel. Their contents have to be controlled strictly. In the steel of the type according to the invention, the phosphorus content is controlled to be less than 0.015%, preferably ≤0.010%; and sulfur content is ≤0.010%, preferably ≤0.005%.

Nitrogen, oxygen and hydrogen: Excessive oxygen and nitrogen in steel are quite undesirable for the properties of the steel, especially weldability and toughness. However, overly strict control will increase the production cost to a great extent. Therefore, in the steel of the type according to the invention, the nitrogen content is controlled to be ≤0.0080%, preferably ≤0.0050%; the oxygen content is ≤0.0060%, preferably ≤0.0040%; and the hydrogen content is ≤0.0004%, preferably ≤0.0003%.

The method of manufacturing the above high-hardness, high-toughness, wear-resistant steel plate according to the invention comprises in sequence the steps of smelting, casting, heating, rolling and post-rolling direct cooling, etc. In the heating step, the material is heated to 1000-1250° C. In the rolling step, the initial rolling temperature is 950-1200° C. and the end rolling temperature is 800-950° C. In the cooling step, water cooling is used and the end cooling temperature is from room temperature to 300° C.

Preferably, in the heating process, the heating temperature is 1000-1200° C., more preferably 1050-1200° C. In order to guarantee sufficient diffusion of carbon and alloy elements, and prevent excessive growth of the austenite grains and severe oxidation of the billet surface, the heating temperature is most preferably 1050-1150° C.

Preferably, the initial rolling temperature: 950-1150° C.; the end rolling temperature: 800-900° C.; more preferably, the initial rolling temperature: 950-1120° C.; the end rolling temperature: 810-900° C.; and most preferably, the initial rolling temperature: 980-1100° C.; the end rolling temperature: 810-890° C.

Preferably, the end cooling temperature is from room temperature to 280° C., more preferably from room temperature to 250° C., most preferably from room temperature to 200° C.

TABLE 1

Chemical compositons of Examples 1-6 according to the invention and Comparative Example 1 (wt. %)

| | C | Si | Mn | P | S | Nb | Al | B | Ti |
|---|---|---|---|---|---|---|---|---|---|
| Ex. 1 | 0.36 | 0.28 | 1.00 | 0.015 | 0.005 | 0.040 | 0.020 | 0.0010 | 0.010 |
| Ex. 2 | 0.37 | 0.21 | 0.90 | 0.009 | 0.003 | 0.020 | 0.060 | 0.0015 | 0.050 |
| Ex. 3 | 0.39 | 0.30 | 0.73 | 0.010 | 0.010 | 0.010 | 0.038 | 0.0018 | 0.025 |
| Ex. 4 | 0.42 | 0.23 | 0.58 | 0.008 | 0.004 | 0.020 | 0.035 | 0.0013 | 0.005 |
| Ex. 5 | 0.44 | 0.16 | 0.51 | 0.009 | 0.002 | 0.035 | 0.010 | 0.0020 | 0.045 |
| Ex. 6 | 0.45 | 0.10 | 0.40 | 0.007 | 0.002 | 0.021 | 0.080 | 0.0016 | 0.040 |
| Comp. 1 | 0.52 | 0.8 | 0.51 | <0.024 | <0.03 | — | — | — | — |

Chemical compositons of Examples 1-6 according to the invention and Comparative Example 1 (wt. %)

| | Ca | V | Cr | RE | N | O | H | Others |
|---|---|---|---|---|---|---|---|---|
| Ex. 1 | 0.0080 | 0.080 | 0.58 | 0.08 | 0.0080 | 0.0060 | 0.0004 | — |
| Ex. 2 | 0.0020 | 0.060 | 1.00 | 0.06 | 0.0050 | 0.0028 | 0.0003 | — |
| Ex. 3 | 0.0050 | / | / | 0.10 | 0.0044 | 0.0021 | 0.0002 | — |
| Ex. 4 | 0.0010 | / | / | / | 0.0035 | 0.0040 | 0.0003 | — |
| Ex. 5 | 0.0060 | 0.036 | 0.35 | / | 0.0026 | 0.0027 | 0.0002 | — |
| Ex. 6 | 0.0030 | 0.041 | 0.80 | 0.05 | 0.0031 | 0.0021 | 0.0002 | — |
| Comp. 1 | — | 0.3 | 4.2 | 0.035 | — | — | — | Mo:0.5 |

EXAMPLES

Table 1 shows the mass percentages of the chemical elements in the steel plates according to Examples 1-6 of the invention and Comparative Example 1 (CN 1140205A).

The raw materials for smelting were subjected to the manufacturing process according to the following steps: smelting→casting→heating→rolling→post-rolling direct cooling.

The specific process parameters for Examples 1-6 and Comparative Example 1 are shown in Table 2.

TABLE 2

Specific process parameters for Examples 1-6 according to the invention

| Examples | Slab heating temperature ° C. | Hold time (h) | Initial rolling temperature ° C. | End rolling temperature ° C. | Cooling method | End Cooling temperature ° C. | Steel plate thickness mm |
|---|---|---|---|---|---|---|---|
| 1 | 1000 | 2 | 950 | 800 | Water cooling | 300 | 12 |
| 2 | 1150 | 2 | 1100 | 839 | Water cooling | 95 | 28 |
| 3 | 1120 | 2 | 1050 | 827 | Water cooling | 200 | 15 |
| 4 | 1050 | 2 | 980 | 810 | Water cooling | 128 | 21 |
| 5 | 1200 | 2 | 1150 | 900 | Water cooling | 55 | 16 |
| 6 | 1250 | 2 | 1200 | 950 | Water cooling | Room temperature | 19 |

Test 1: Test for Mechanical Properties

Sampling was conducted according to the sampling method described in GB/T2974, and the high-hardness, high-toughness, wear-resistant steel plates of Examples 1-6 of the invention were subjected to hardness test according to GB/T231.1 and impact test according to GB/T229. The results are shown in Table 3.

TABLE 3

Mechanical properties of Examples 1-6 of the invention and Comparative Example 1

| | Hardness, HBW | Charpy V-notch longitudinal impact work(−40° C.), J |
|---|---|---|
| Ex. 1 | 577 | 55 |
| Ex. 2 | 595 | 46 |
| Ex. 3 | 602 | 56 |
| Ex. 4 | 613 | 59 |
| Ex. 5 | 619 | 49 |
| Ex. 6 | 628 | 42 |
| Comp. 1 | About 550 (HRC54) | — |

As can be seen from Table 3, the steel plates of Examples 1-6 of the invention exhibit 570-630HBW of hardness, and 40-60 J of Charpy V-notch longitudinal impact work at −40° C. This indicates that the steel plates of the invention have excellent mechanical properties. The steel plates of the invention have higher hardness than the steel plate of Comparative Example 1, and have relatively good impact toughness.

FIG. 1 shows the microstructure of the steel plate according to Example 5, which comprises fine martensite and a small amount of residual austenite and guarantees that the steel plate has good mechanical properties.

Similar microstructures were obtained for the other examples.

Test 2: Test for Wear Resistance

The wear resistance test was performed on an ML-100 abrasive-wear tester. When a sample was cut out, the axis of the sample was perpendicular to the surface of the steel plate, so that the wearing surface of the sample was just the rolling surface of the steel plate. The sample was machined as required into a stepwise cylinder, wherein the size of the testing part was Φ4 mm, and the size of the holding part for a fixture was Φ5 mm Before testing, the sample was washed with alcohol, dried using a blower, and weighed on a balance having a precision of 1/10000 for the sample weight which was used as the original weight. Then, the sample was amounted on a flexible fixture. The test was conducted using an 80 mesh sand paper at a 42N load. After testing, due to the abrasion between the sample and the sand paper, the sample scribed a spiral line on the sand paper. The length of the spiral line was calculated with the initial and final radii of the spiral line according to the following formula:

$$S = \frac{\pi(r_1^2 - r_2^2)}{a}$$

wherein r1 is the initial radius of the spiral line, r2 is the final radius of the spiral line, and a is the feed rate of the spiral line. In each experiment, the sample was weighed three times and an average was obtained. Then, the weight loss was calculated, and the weight loss per meter was used to represent the wear rate (mg/M) of the sample.

The high-hardness, high-toughness, wear-resistant steel plates of Examples 1-6 of the invention were tested for wear resistance. Table 4 shows the wear testing results of the steel type in the Examples of the invention and the steel in Comparative Example 2 (the hardness of the steel plate of Comparative Example 2 was 550HBW).

TABLE 4

Wear testing results of Examples 1-6 of the invention and Comparative Example

| Steel type | Testing temperature | Wear testing conditions | Wear rate (mg/M) |
|---|---|---|---|
| Ex. 1 | Room temperature | 80 mesh sand paper/ 42N load | 6.223 |
| Ex. 2 | Room temperature | 80 mesh sand paper/ 42N load | 5.951 |
| Ex. 3 | Room temperature | 80 mesh sand paper/ 42N load | 5.693 |
| Ex. 4 | Room temperature | 80 mesh sand paper/ 42N load | 5.492 |
| Ex. 5 | Room temperature | 80 mesh sand paper/ 42N load | 5.318 |
| Ex. 6 | Room temperature | 80 mesh sand paper/ 42N load | 5.203 |
| Comp. 2 | Room temperature | 80 mesh sand paper/ 42N load | 6.656 |

As can be known from Table 4, under such wearing conditions, the high-hardness, high-toughness, wear-resistant steel plates of the invention have better wear resistance than the steel plate of Comparative Example 2.

The contents of carbon and trace alloy are controlled strictly according to the invention by reasonably designing the chemical composition (the contents and ratios of C, Si, Mn, Nb and other elements). The production cost of wear-resistant steel is decreased greatly due to the absence of such elements as Mo, Ni and the like. The steel plate according to the invention has very high hardness and good impact toughness, inter alia, is easy for machining such as cutting, bending, etc., and has very good applicability. The high-hardness, high-toughness, wear-resistant steel plate produced according to the invention exhibits 570-630HBW of hardness, and 40-60 J of Charpy V-notch longitudinal impact work at −40° C. It has excellent mechanical properties and very good applicability.

The invention claimed is:

1. A wear-resistant steel plate, which consists of the following chemical components in weight percentages: C:0.36-0.45%, Si: 0.10-0.30%, Mn: 0.40-1.00%, P≤0.015%, S≤0.010%, Nb: 0.010-0.040%, Al: 0.010-0.080%, B: 0.0010-0.0020%, Ti: 0.005-0.050%, Ca: 0.0010-0.0080%, V≤0.080%, Cr≤1.00%, RE≤0.10%, N≤0.0080%, O≤0.0060%, H≤0.0004%, wherein the total amount of Nb and Ti is between 0.025% and 0.080%, the total amount of Al and Ti is between 0.030% and 0.12%, and the balance being Fe and unavoidable impurities.

2. The wear-resistant steel plate of claim 1, wherein C: 0.37-0.44%.

3. The wear-resistant steel plate of claim 1, wherein Si: 0.10-0.28%.

4. The wear-resistant steel plate of claim 1, wherein Mn: 0.40-0.90%.

5. The wear-resistant steel plate of claim 1, wherein P≤0.010% or S≤0.005%.

6. The wear-resistant steel plate of claim 1, wherein Nb: 0.010-0.035%.

7. The wear-resistant steel plate of claim 1, wherein Al: 0.020-0.060%.

8. The wear-resistant steel plate of claim 1, wherein B: 0.0010-0.0018%.

9. The wear-resistant steel plate of claim 1, wherein Ti: 0.010-0.045%.

10. The wear-resistant steel plate of claim 1, wherein Ca: 0.001-0.006%.

11. The wear-resistant steel plate of claim 1, wherein V≤0.060%, Cr≤0.80%, RE≤0.08%, N≤0.0050%, O≤0.0040%, or H≤0.0003%.

12. The wear-resistant steel plate of claim 1, wherein the total amount of Nb and Ti is between 0.035% and 0.070%, and the total amount of Al and Ti is between 0.040% and 0.11%.

13. The wear-resistant steel plate of claim 1, having a Brinell hardness of 570-630HBW or 600-630HBW; and having a Charpy V-notch longitudinal impact work at −40° C. of 40-60 J.

14. A method of manufacturing the wear-resistant steel plate of claim 1, comprising in sequence the steps of smelting, casting, heating, rolling and post-rolling direct cooling; wherein in the heating step, the heating temperature is 1000-1250° C. and the hold time is 1-2 hours;

in the rolling step, the initial rolling temperature is 950-1200° C. and the end rolling temperature is 800-950° C.; and in the post-rolling direct cooling step, water cooling is used and the end cooling temperature is from room temperature to 300° C.

15. The method of manufacturing the wear-resistant steel plate according to claim 14, wherein:

the temperature for heating a slab is 1000-1200° C. in the heating step, the initial rolling temperature is 950-1150° C. and the end rolling temperature is 800-900° C. in rough rolling, the end cooling temperature is from room temperature to 280° C., the hold time is 1-2 hours, or the hold time is 2 hours.

* * * * *